US008186609B2

(12) United States Patent
Rapp et al.

(10) Patent No.: US 8,186,609 B2
(45) Date of Patent: May 29, 2012

(54) FUEL INJECTOR HAVING AN ADDITIONAL OUTLET RESTRICTOR OR HAVING AN IMPROVED ARRANGEMENT OF SAME IN THE CONTROL VALVE

(75) Inventors: Holger Rapp, Ditzingen (DE); Wolfgang Stoecklein, Waiblingen (DE); Andreas Rettich, Herrenberg-Kuppingen (DE)

(73) Assignee: Robert Bosch GmbH, Stuttgart (DE)

( * ) Notice: Subject to any disclaimer, the term of this patent is extended or adjusted under 35 U.S.C. 154(b) by 319 days.

(21) Appl. No.: 12/528,604

(22) PCT Filed: Jan. 17, 2008

(86) PCT No.: PCT/EP2008/050507
§ 371 (c)(1), (2), (4) Date: Aug. 25, 2009

(87) PCT Pub. No.: WO2008/104423
PCT Pub. Date: Sep. 4, 2008

(65) Prior Publication Data

US 2010/0319660 A1 Dec. 23, 2010

(30) Foreign Application Priority Data

Feb. 26, 2007 (DE) ..... 10 2007 009 165

(51) Int. Cl.
*F02M 47/02* (2006.01)

(52) U.S. Cl. ..... 239/533.3; 239/96; 123/459; 123/445

(58) Field of Classification Search ..... 123/445, 123/459; 239/96, 585.1, 585.5, 533.1, 533.3
See application file for complete search history.

(56) References Cited

U.S. PATENT DOCUMENTS

| | | | | |
|---|---|---|---|---|
| 7,021,567 | B2 * | 4/2006 | Sander-Potz et al. | 239/533.4 |
| 7,299,998 | B2 * | 11/2007 | Ricco et al. | 239/96 |
| 7,954,729 | B2 * | 6/2011 | Ricco et al. | 239/96 |
| 2004/0050954 | A1 * | 3/2004 | Yamada et al. | 239/102.2 |
| 2006/0000453 | A1 | 1/2006 | Ricco et al. | |

(Continued)

FOREIGN PATENT DOCUMENTS

| | | | |
|---|---|---|---|
| EP | 1126160 | A2 | 8/2001 |

(Continued)

*Primary Examiner* — Erick Solis
(74) *Attorney, Agent, or Firm* — Ronald E. Greigg

(57) ABSTRACT

The present invention relates to a fuel injector for injecting fuel into a combustion chamber of an internal combustion engine, having a valve piston that is displaceably guided in an injector body in terms of lifting motions, whereby the lifting motion of the valve piston can be controlled by a control valve. The control valve has a valve needle with a guide bore, so that the needle is displaceably guided in the direction of a lifting axis in terms of lifting motions. A guide section integrally formed on an end of a valve piece extends into the guide bore for the displaceable guidance of the valve needle in terms of lifting motions. Along the lifting axis a vertical bore extends through the valve piece into the guide section, such that fuel is able to flow through the bore from a control chamber into an annular chamber introduced between the guide bore and the guide section for controlling the lifting motion of the valve piston. The fuel volume conducted through the vertical bore furthermore flows through at least one outlet restrictor, which is disposed in the region of the transition from the vertical bore into the annular chamber.

18 Claims, 3 Drawing Sheets

U.S. PATENT DOCUMENTS

| | | | | |
|---|---|---|---|---|
| 2006/0027684 | A1 | 2/2006 | Ricco et al. | |
| 2006/0032950 | A1 * | 2/2006 | Ricco et al. | 239/585.1 |
| 2006/0266846 | A1 | 11/2006 | Ricco et al. | |
| 2007/0205302 | A1 | 9/2007 | Ricco et al. | |

FOREIGN PATENT DOCUMENTS

| | | | |
|---|---|---|---|
| EP | 1612404 | A1 | 1/2006 |
| EP | 1731752 | A1 | 12/2006 |
| JP | 2006017107 | A | 1/2006 |

* cited by examiner

FUEL INJECTOR HAVING AN ADDITIONAL OUTLET RESTRICTOR OR HAVING AN IMPROVED ARRANGEMENT OF SAME IN THE CONTROL VALVE

CROSS-REFERENCE TO RELATED APPLICATION

This application is based on PCT/EP2008/050507 filed on Jan. 17, 2008.

BACKGROUND OF THE INVENTION

1. Field of the Invention

The present invention relates to a fuel injector for injecting fuel into a combustion chamber of an internal combustion engine.

2. Description of the Prior Art

The publication EP 1 612 403 A1 has disclosed a fuel injector of this generic type that includes a valve piston, which is guided so that it is able to execute a stroke motion in an injector body and cooperates with the nozzle needle in its stroke motion. According to another design of fuel injectors likewise of this generic type, the nozzle needle protrudes directly into the region of the control valve. The valve piston and the nozzle needle delimit a control chamber that can be acted on with high fuel pressure. If the control chamber is acted on with high fuel pressure, then the valve piston and nozzle needle are moved along the stroke axis toward the injection openings in the lower region of the fuel injector so that the injection openings are closed. If the pressure in control chamber is relieved, then the valve piston and valve needle lift away from the injection openings by executing a movement along the stroke axis. Consequently, the movement of the valve piston and nozzle needle can be controlled by means of the pressure in the control chamber. The fuel injector also includes a valve component that transitions into a guide section that is cylindrically embodied and extends into the guide bore of a valve needle. Consequently, the valve needle is guided on the guide section and is able to assume an open position and a closed position by moving along the stroke axis.

In order to vent the control chamber, a conduit system is provided, which is composed of a riser bore and at least one transverse bore. These bores vent the control chamber into an annular chamber that is provided in the form of a constriction in the circumference region of the guide section. If the valve needle is situated in a lower vertical position along the stroke axis, then the annular chamber is closed so that the pressure in the control chamber remains at the high fuel pressure level. If the valve needle is lifted, then this allows the compressed fuel to flow out of the annular chamber into a discharge chamber so that the pressure in the control chamber decreases. Adjoining the control chamber in the transition to the riser bore, an output throttle is provided in order to limit the rate of the pressure decrease and therefore the stroke speed of the valve needle.

With such an arrangement of an output throttle, the problem arises that a large dead volume or waste volume prevails in the region of the riser bore, the transverse bores, and the annular chamber. Since the large opening cross section of the control valve causes a cavitation to rapidly occur in the flow in the region of the output throttle or downstream of it during an opening stroke of the valve needle with a large armature stroke (>20 μm), the volume in which this cavitation occurs is filled up with vapor. After the closing of the control valve, the volume must be refilled with fuel in opposition to the gas pressure; the pressure is increased up to the high fuel pressure (rail pressure). Only then does the valve piston cause the nozzle needle to close the injection openings again. The greater the proportion of vapor inside the waste volume, the longer the closing procedure of the nozzle needle takes; this closing procedure is subject to correspondingly large variances. This impairs the stability of the injections and the stroke-to-stroke variance increases from injection to injection. There is also a rise in the possible interval before a subsequent injection, thus decreasing the efficiency of multiple injections.

The object of the present invention, therefore, is to create a fuel injector in which it is possible to reduce the waste volume downstream of the output throttle and consequently to reduce the variance from injection to injection. Another object of the present invention is to reduce the time required to build up the high fuel pressure inside the control chamber.

SUMMARY OF THE INVENTION

The invention includes the technical teaching that the output throttle is situated in the region of the transition from the riser bore into the annular chamber.

The output throttle arrangement according to the invention achieves the advantage that between the outlet chamber, in which a low pressure prevails in the fuel, and the output throttle, a small volume remains; the fact that this remaining volume is small also reduces the waste volume. Only the volume of the annular chamber and parts of the conduits for supplying fuel between the riser bore and the annular chamber constitute a possible waste volume so that according to another advantageous embodiment, it is possible for the annular chamber itself to be embodied as comparatively small. It is thus possible to further reduce the waste volume in order to further improve upon the advantages of the present invention.

According to another advantageous embodiment of the invention, the riser bore opens into a transverse bore oriented transversely to it, which is provided in the guide section and extends along a transverse bore axis, and upstream of its opening into the transverse bore, the riser bore has a cross-sectionally constricting throttle geometry in order to form the output throttle. This demonstrates a first possible embodiment of the present invention that makes it possible to produce an output throttle for throttling the control volume of the fuel. The transverse bore can be positioned transversely in relation to the direction in which the stroke axis extends so that for example in a continuous form extending across the whole diameter of the guide section, this transverse bore opens out into the annular chamber in two locations. The transition from the riser bore into the transverse bore is provided with a constriction in order to produce the throttling action. Thanks to a double opening of the transverse bore into the annular chamber, the discharging of the fuel volume occurs symmetrically when the valve needle opens so that in addition, the fuel flowing out of the transverse bore does not flow against the valve needle in a one-sided fashion. The constriction provided in order to form the throttle can be produced by means of the laser drilling method, making it possible to implement short cycle times and to produce an optimal geometry of the output throttle.

An advantageous geometry of the output throttle according to the invention can include a cross-sectionally constricting throttle geometry that involves a cylindrical and/or funnel-shaped geometry. In this case, the funnel-shaped opening is oriented toward the transverse bore. It is also possible to provide a rounding of the edges in order to optimize the flow of fuel through the throttle restriction. This prevents the fuel flow from experiencing as many powerful deflections. It should in particular be noted that a one-piece variant is possible so that the guide section and the valve component are on the whole of one piece with each other and composed of the same material. In addition, the valve seat can also be situated at the upper end of the armature guide without influencing the function. Consequently, even a throttle restriction situated further toward the top does not result in any increase in waste volume.

In the method for producing a throttle restriction of this kind, the riser bore can be drilled in the form of a blind hole, with the transverse bore then being produced in the form of a through bore. This is followed by a laser drilling of the output throttle, thus producing the connection between the blind hole, the riser bore, and the transverse bore. This is followed by an HE rounding of the edges inside the throttle cross section to achieve the required throttle flow.

Another advantageous embodiment of the arrangement according to the invention and the corresponding embodiment of the output throttle is achieved in that the transverse bore has a transverse bore cross section and the riser bore has a riser bore cross section, with the transverse bore cross section being smaller than the riser bore cross section in order to form the output throttle itself. The transverse bore in this case can extend through the entire diameter of the guide section so that the fuel exits from the riser bore into the annular chamber via two openings of the transverse bore. It is also possible to provide two or more transverse bores in the guide sections and the fuel quantity emerging from the riser bore divides into these transverse bores in order to travel into the annular chamber via the respective transverse bores. In this case, care must be taken that the openings for the fuel leading out of the transverse bores are symmetrically distributed over the circumference of the annular chamber in order to avoid a one-sided flow against the valve needle. The output throttle itself is produced by the reduced cross section of the transverse bore; the ratio of the bore diameter of the transverse bore to the diameter of the riser bore can involve a factor of 1.25 . . . 5. It is thus possible, for example, for the riser bore to have a cross section of 1 mm and the transverse bore to have a cross section of 0.3 mm, thus yielding a ratio of 3.33. Another example can be constituted by a riser bore with a cross section of 1 mm and a transverse bore with a cross section of 0.8 mm, thus yielding a cross-sectional ratio with a factor of 1.25.

A third embodiment of the present invention is constituted by an output throttle, which is characterized in that at least one throttle bore—with a throttle cross section that is smaller than the riser bore cross section in order to form the output throttle—extends between the end of the riser bore and the annular chamber. In this case, before emerging into the annular chamber, the cross section of the throttle bore widens out to form a diffuser section with a larger diameter. The diffuser section can be either cylindrically or conically embodied, with the opening of the cone oriented toward the annular chamber. The throttle bore has a cross section that is embodied as narrow so as to produce the desired throttling action. In the diffuser section adjoining the throttle bore section, the flow of the fuel can become homogeneous over the flow cross section so that it flows into the annular chamber in a steadier state.

It is advantageous that the throttle bore and the diffuser section extend along a bore axis and this axis extends at an angle to the stroke axis, said angle having a value between 20° and 80°, preferably between 30° and 60°, and particularly preferably a value of 45°. This optimizes the flow behavior so that the fuel is not subject to a flow deflection of 90°—as in the case of a transverse bore. This achieves a steadier fuel flow, making it possible to achieve a better control of the throttling action. Both the section constituted by the throttle bore and the subsequent section of the diffuser bore extend together concentrically in relation to the bore axis. It is thus possible to first provide the diffuser section in the form of a blind hole extending along the bore axis and then producing the throttle bore in the second work step. The throttle bore can either be mechanically drilled in a conventional fashion, with an erosion method or laser drilling method also representing advantageous applications, both of which have the capacity to produce very small and precise bore geometries. In particular, after the bores have been produced, a rounding of edges can be carried out so that edge effects in the fuel flow do not exert any negative influence.

It is also advantageous that at least two throttle bores extend between the end of the riser bore and the annular chamber, which are situated opposite each other by an angle of 180°. It is also possible to position a plurality of throttle bores with adjoining diffuser sections so that the respective bore axes extend out from the guide section into the annular chamber, distributed in a radially uniform fashion over the circumference of the guide section.

DESCRIPTION OF THE PREFERRED EMBODIMENTS

Other measures that improve the invention will be explained in greater detail below together with the description of a preferred exemplary embodiment of the invention in conjunction with the drawings, in which.

DESCRIPTION OF THE PREFERRED EMBODIMENTS

Figure 1:
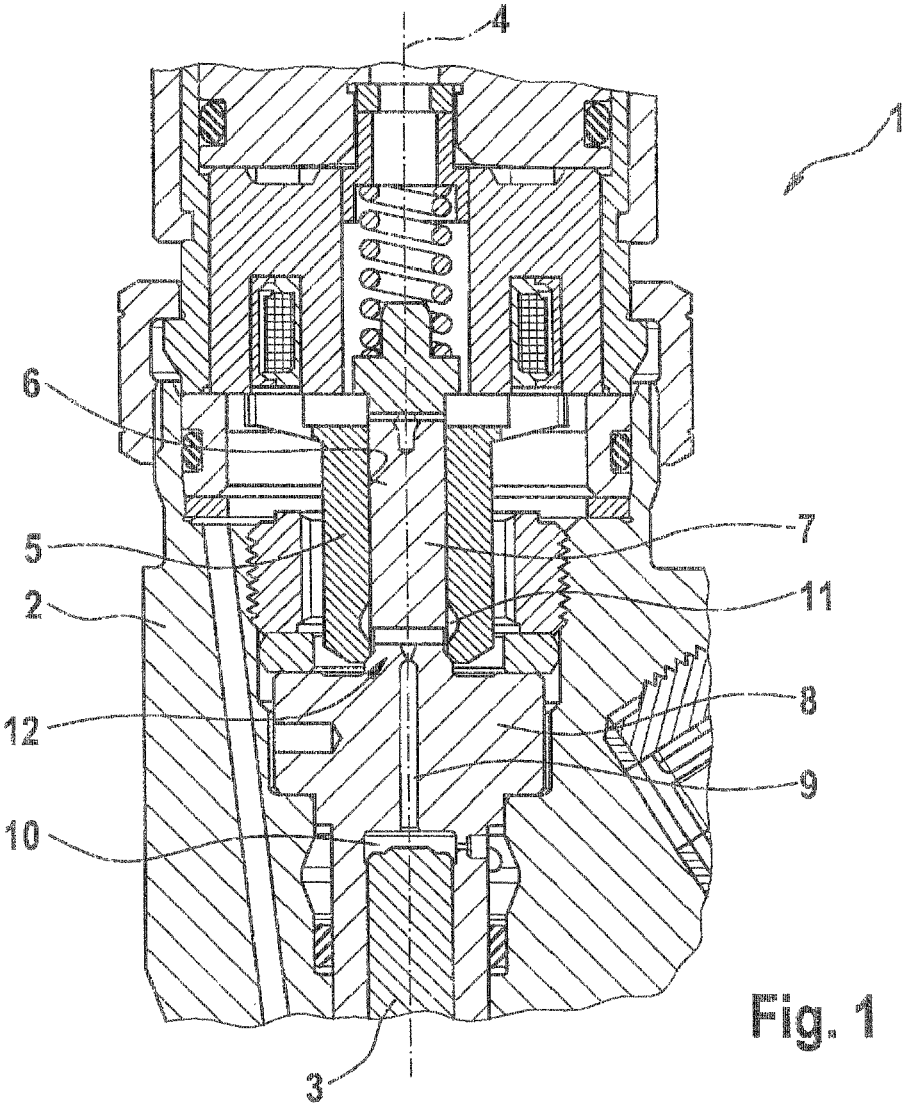
FIG. 1 is a cross-sectional side view of a fuel injector according to the invention, according to a first exemplary embodiment of the invention.
Figure 2:
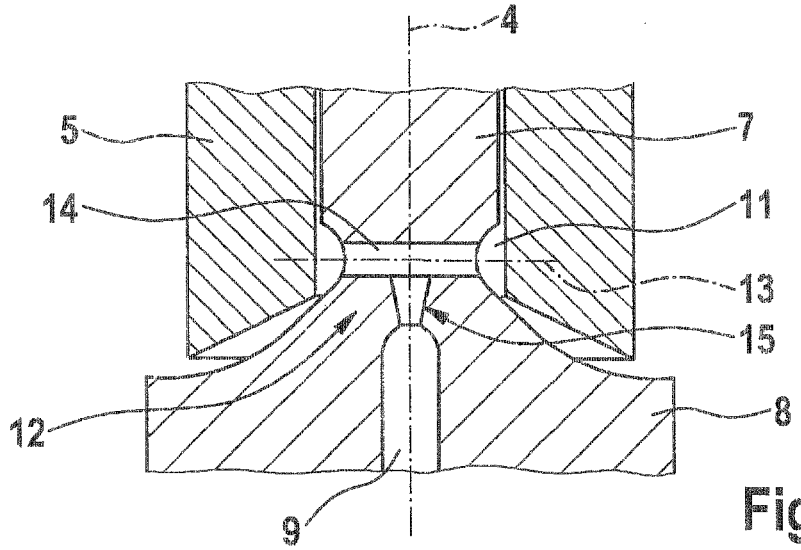
FIG. 2 shows an enlarged detail of the output throttle embodiment according to the invention, with a throttle geometry between the riser bore and the transverse bore.
Figure 3:
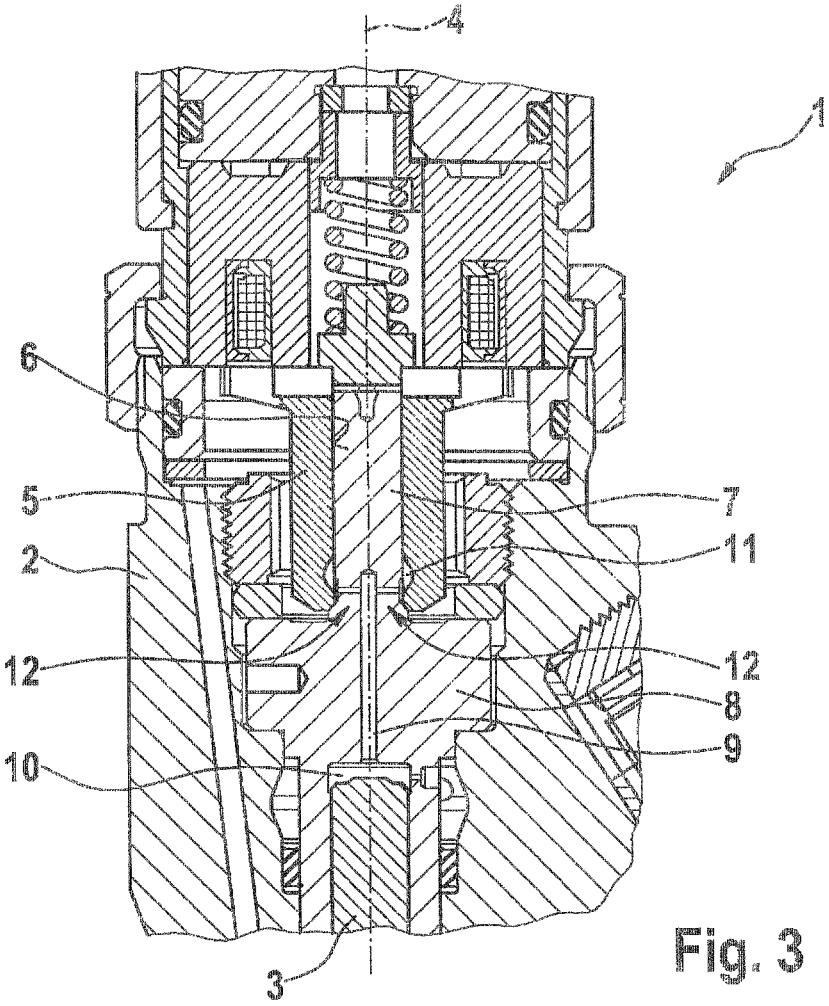
FIG. 3 is a cross-sectional side view of a fuel injector with an output throttle arrangement according to the invention, according to a second exemplary embodiment of the invention.
Figure 4:
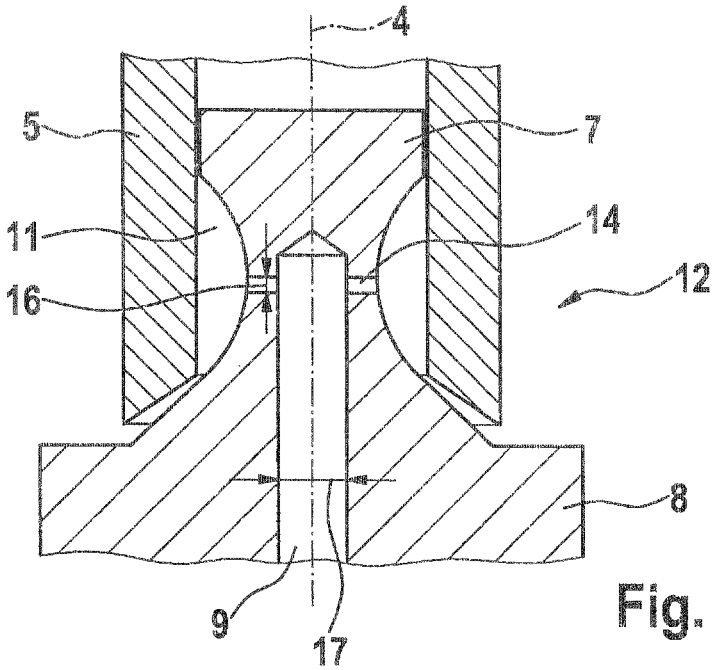
FIG. 4 shows an enlarged view of the second exemplary embodiment of the output throttle according to the invention, with a corresponding cross-sectional geometry of the transverse bore.
Figure 5:
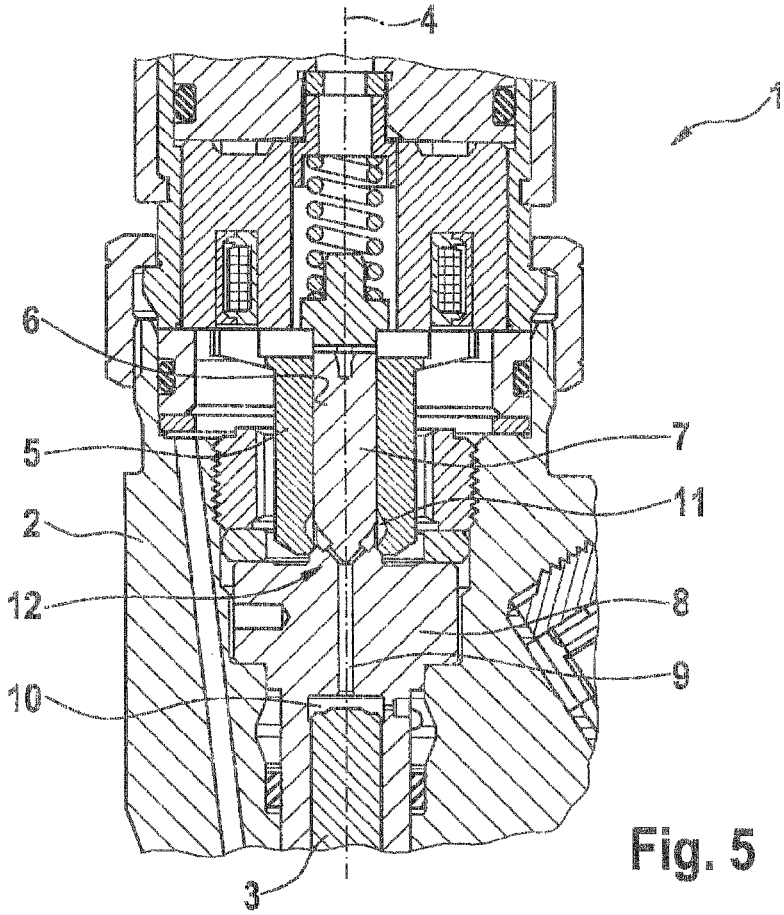
FIG. 5 is a cross-sectional side view of a fuel injector with a third exemplary embodiment of an output throttle according to the present invention.

FIGS. 1, 3, and 5 show respective views of a fuel injector 1 and merely depict different embodiments of the output throttle 12 according to the invention. The fuel injector 1 according to the invention has an injector body 2 in which a valve piston 3 is guided so that it is able to execute a stroke motion. The stroke motion of the valve piston 3 occurs along a stroke axis 4 and the end of the valve piston 3 delimits a control chamber 10. The control chamber 10 can be acted on with high fuel pressure via an inlet throttle so that when high pressure is prevailing in the control chamber 10, the valve piston 3 is pushed toward the injection nozzles—not shown in detail—inside the injector body 2. If the pressure in the control chamber 10 is relieved, then the valve piston 3 can move vertically upward in the direction of the stroke axis 4, thus uncovering the injection openings. The fuel flows out of the control chamber 10 via a riser bore 9, which extends through a valve component 8. The valve component 8 is adjoined by a guide section 7 formed onto it, which transitions into the valve component 8 and is both of one piece with it and composed of the same material as it. The guide section 7 has a cylindrical shape that extends into the guide bore 6 of a valve needle 5. As a result, the valve needle 5 is guided so that it can execute a stroke motion on the guide section 7, in the direction of the stroke axis 4 and can be pulled vertically upward by means of an electromagnet. If the electromagnet is supplied with current, then an attraction is exerted on the valve needle 5 by means of an armature section formed onto it so that the valve needle 5 moves into an open position. If the supply of current to the electromagnet is switched off, then a valve spring pushes the valve needle 5 vertically downward, back into the sealing seat. The sealing action is produced by a sealing edge at the lower end of the valve needle 5, which comes into annular, sealed contact with the guide section or the valve component. The fuel travels through the riser bore 9; the output throttle according to the invention is formed by a corresponding geometric embodiment between the riser bore 9 and the annular chamber 11. The different exemplary embodiments of the output throttle according to the invention are shown in detail views in FIGS. 2, 4, and 6 and will be described below.

FIG. 2 shows the output throttle 12 according to a first exemplary embodiment of the invention. The enlarged sectional view in FIG. 2 shows the riser bore 9 inside the valve component 8, which protrudes at least partially into the guide section 7. A transverse bore 14 is provided extending transversely in relation to the riser bore 9; a throttle geometry 15 is provided in the region of the transition from the riser bore 9 into the transverse bore 14. Consequently, the fuel travels out of the control chamber through the riser bore 9 so that when the valve needle 5 is moved vertically upward in the direction of the stroke axis 4, fuel can travel out of the annular chamber 11 and into the region outside of the valve needle 5. As a result, the fuel travels from the riser bore 9 into the annular chamber 11 via the transverse bore 14 so that it flows through the throttle geometry 15. The throttle geometry has a funnel-shaped contour, with the opening of the funnel oriented toward the transverse bore 14. The transition from the riser bore into the funnel-shaped region of the throttle geometry includes a flow constriction in order to produce the required throttling action. Consequently, the pressure in the riser bore 9 remains at an elevated level even when the valve needle 5 is in the open position so that the waste volume is not constituted inside the riser bore 9, but is instead either completely eliminated or is situated only in the region of the annular chamber, said chamber, however, being embodied as correspondingly small.

FIG. 4 shows another exemplary embodiment of an output throttle according to the invention, in the region of the transition from the riser bore 9 into the annular chamber 11. The riser bore 9 embodied inside the valve component 8 has a riser bore cross section 17, which in this exemplary embodiment is embodied as significantly larger than the transverse bore cross section 16 of the transverse bore 14. The transverse bore 14 extends transversely in relation to the direction of the stroke axis 4 and constitutes the connection between the riser bore 9 and the annular chamber 11. If the fuel flows out of the riser bore 9 into the annular chamber 11 via the transverse bore 14, then the small cross section of the transverse bore 14, which has the transverse bore cross section 16, constitutes the output throttle 12. According to this depiction, the transverse bore 14 is positioned over the entire cross section of the guide section 7 in the region of the annular chamber 11 so that the fuel flows into the annular chamber 11 from two openings. If the transverse bore cross section 16 is embodied as smaller, then this increases the throttling action of the output throttle; a larger cross section decreases the throttling action.

Figure 6:
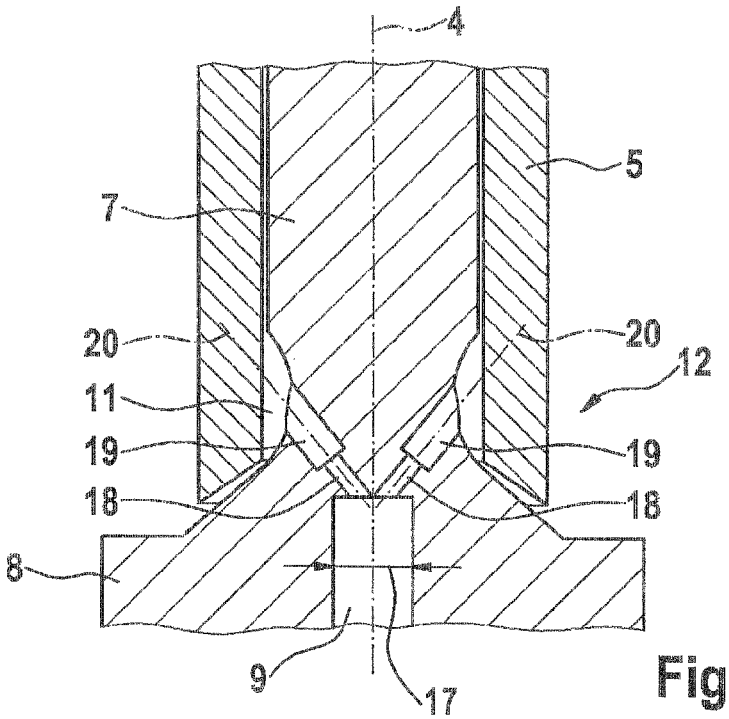
FIG. 6 is an enlarged view of the output throttle according to the third exemplary embodiment.

FIG. 6 shows a third exemplary embodiment of the output throttle 12 according to the invention, in the region between the riser bore 9 and the annular chamber 11. This output throttle is composed of two bore axes extending at an angle of approximately 45° in relation to the stroke axis 4 so that the fuel flows out of the riser bore 9 into the annular chamber 11 via the respective throttle bores 18. The throttle bores 18 have a small cross section in order to produce the throttling action; before entering the annular chamber, they transition into an enlarged diffuser section 19. The diffuser section has an enlarged cross section so that the fuel quantity exiting the throttle bore is able to become steady in order to flow into the annular chamber 11 with a lower level of flow turbulence. The cross section of the riser bore 9 with the riser bore cross section 17 can be embodied in any size without the volume constituting a waste volume since according to this exemplary embodiment of the output throttle 12 as well, a high level of fuel develops in the riser bore 9 even when the valve needle 5 is in the open position. By virtue of the arrangement of the throttle bore 18 and the diffuser section 19 along the bore axis 20 at an angle of approximately 45°, the fuel does not have to be deflected and the flow conduit as a whole has a soft contour. However, the exemplary embodiment of the output throttle 12 according to the depiction in FIG. 6 is not limited to the embodiment at a corresponding angle, but can also be provided corresponding to the embodiment in FIG. 4 at an angle of 90° in relation to the direction in which the stroke axis 4 extends.

The embodiments of the invention is not limited to the preferred exemplary embodiments given above. On the contrary, there are a number of conceivable variants that make use of the embodiments depicted, even in embodiments of fundamentally differing nature.

The invention claimed is:

1. A fuel injector for injecting fuel into a combustion chamber of an internal combustion engine, having a valve piston, which is guided so that it is able to execute a stroke motion in an injector body, the stroke motion of the valve piston being controlled by a control valve having a valve needle, which valve needle is guided so that it is able to execute a stroke motion in a direction of a stroke axis, and having a guide bore into which a guide section formed onto an end of a valve component extends in order to guide the valve needle so that it is able to execute the stroke motion, wherein a riser bore extends along the stroke axis through the valve component and into the guide section and fuel is able to flow through the riser bore out of a control chamber for controlling the stroke of the valve piston and into an annular chamber provided between the guide bore and the guide section, wherein a fuel quantity conveyed through the riser bore also flows through at least one output throttle which is situated in a region of a transition from the riser bore into the annular chamber, wherein the at least one output throttle includes at least one throttle bore having a throttle cross section that is smaller than the riser bore cross section in order to form the output throttle that extends between an end of the riser bore and the annular chamber, wherein the cross section of the throttle bore widens out before emerging into the annular chamber in order to form a diffuser section with a larger diameter, and wherein the diffuser section is conically embodied, with an opening of a cone oriented toward the annular chamber.

2. The fuel injector as recited in claim 1, wherein the riser bore opens into a transverse bore oriented transversely thereto, which transverse bore is provided in the guide section and extends along a transverse bore axis, and upstream of its opening into the transverse bore, the riser bore has a cross-sectionally constricting throttle geometry in order to form the output throttle.

3. The fuel injector as recited in claim 2, wherein the cross-sectionally constricting throttle geometry includes a cylindrical and/or funnel-shaped geometry, with the funnel-shaped opening oriented toward the transverse bore.

4. The fuel injector as recited in claim 2, wherein the transverse bore has a transverse bore cross section and the riser bore has a riser bore cross section, with a cross section of the transverse bore being smaller than a cross section of the riser bore in order to form the output throttle.

5. The fuel injector as recited in claim 3, wherein the transverse bore has a transverse bore cross section and the riser bore has a riser bore cross section, with a cross section of the transverse bore being smaller than a cross section of the riser bore in order to form the output throttle.

6. The fuel injector as recited in claim 1, wherein the transverse bore extends through an entire diameter of the guide section so that the fuel exits from the riser bore into the annular chamber via two openings of the transverse bore.

7. The fuel injector as recited in claim 2, wherein the transverse bore extends through an entire diameter of the guide section so that the fuel exits from the riser bore into the annular chamber via two openings of the transverse bore.

8. The fuel injector as recited in claim 3, wherein the transverse bore extends through an entire diameter of the guide section so that the fuel exits from the riser bore into the annular chamber via two openings of the transverse bore.

9. The fuel injector as recited in claim 4, wherein the transverse bore extends through an entire diameter of the guide section so that the fuel exits from the riser bore into the annular chamber via two openings of the transverse bore.

10. The fuel injector as recited in claim 1, wherein two or more transverse bores are provided in the guide section and the fuel quantity emerging from the riser bore divides into these transverse bores in order to travel into the annular chamber via respective transverse bores.

11. The fuel injector as recited in claim 2, wherein two or more transverse bores are provided in the guide section and the fuel quantity emerging from the riser bore divides into these transverse bores in order to travel into the annular chamber via respective transverse bores.

12. The fuel injector as recited in claim 3, wherein two or more transverse bores are provided in the guide section and the fuel quantity emerging from the riser bore divides into these transverse bores in order to travel into the annular chamber via respective transverse bores.

13. The fuel injector as recited in claim 4, wherein two or more transverse bores are provided in the guide section and the fuel quantity emerging from the riser bore divides into these transverse bores in order to travel into the annular chamber via respective transverse bores.

14. The fuel injector as recited in claim 6, wherein two or more transverse bores are provided in the guide section and the fuel quantity emerging from the riser bore divides into these transverse bores in order to travel into the annular chamber via respective transverse bores.

15. The fuel injector as recited in claim 1, wherein the throttle bore and the diffuser section extend along a bore axis which extends at an angle to the stroke axis, which angle has a value between 20° and 80°, preferably between 30° and 60°, and particularly preferably a value of 45°.

16. The fuel injector as recited in claim 1, wherein at least two throttle bores extend between the end of the riser bore and the annular chamber, which are situated opposite each other by an angle of 180°.

17. The fuel injector as recited in claim 15, wherein at least two throttle bores extend between the end of the riser bore and the annular chamber, which are situated opposite each other by an angle of 180°.

18. A fuel injector for injecting fuel into a combustion chamber of an internal combustion engine, having a valve piston, which is guided so that it is able to execute a stroke motion in an injector body, the stroke motion of the valve piston being controlled by a control valve having a valve needle, which valve needle is guided so that it is able to execute a stroke motion in a direction of a stroke axis, and having a guide bore into which a guide section formed onto an end of a valve component extends in order to guide the valve needle so that it is able to execute the stroke motion, wherein a riser bore extends along the stroke axis through the valve component and into the guide section and fuel is able to flow through the riser bore out of a control chamber for controlling the stroke of the valve piston and into an annular chamber provided between the guide bore and the guide section, wherein a fuel quantity conveyed through the riser bore also flows through at least one output throttle which is situated in a region of a transition from the riser bore into the annular chamber, wherein the riser bore opens into a transverse bore oriented transversely thereto, which transverse bore is provided in the guide section and extends along a transverse bore axis, and upstream of its opening into the transverse bore, the riser bore has a cross-sectionally constricting throttle geometry in order to form the output throttle, and wherein the cross-sectionally constricting throttle geometry includes a funnel-shaped geometry, with a funnel-shaped opening oriented toward the transverse bore.

* * * * *